US005478418A

United States Patent [19]

Miura et al.

[11] Patent Number: 5,478,418

[45] **Date of Patent: * Dec. 26, 1995**

[54] ALUMINUM ALLOY POWDER FOR SLIDING MEMBERS AND ALUMINUM ALLOY THEREFOR

[75] Inventors: Hirohisa Miura, Okazaki; Yasuhiro Yamada, Tajimi; Hirohumi Michioka, Toyota; Jun Kusui; Akiei Tanaka, both of Ohmihachiman, all of Japan

[73] Assignees: Toyota Jidosha Kabushiki Kaisha; Toyo Aluminum Kabushiki Kaisha, both of Japan

[ * ] Notice: The portion of the term of this patent subsequent to Dec. 20, 2011, has been disclaimed.

[21] Appl. No.: 234,578

[22] Filed: Apr. 28, 1994

[30] Foreign Application Priority Data

Apr. 30, 1993 [JP] Japan ..... 5-103382

[51] Int. Cl.[6] ..... C22C 21/12

[52] U.S. Cl. ..... 148/438; 75/244; 75/249; 148/439; 420/529; 420/533; 420/534; 420/535; 420/537; 420/538; 420/542; 420/543; 420/544; 420/546; 420/547; 420/548; 420/550; 420/551

[58] Field of Search ..... 148/438, 439; 75/244, 249; 420/529, 533, 534, 535, 537, 538, 542, 543, 544, 546, 547, 548, 550, 551

[56] References Cited

U.S. PATENT DOCUMENTS 5,374,295 12/1994 Miura et al. ..... 148/438

FOREIGN PATENT DOCUMENTS

| | | |
|---|---|---|
| 0100470 | 2/1984 | European Pat. Off. . |
| 0265307 | 4/1988 | European Pat. Off. . |
| 4-202737 | 7/1992 | Japan . |
| 5-287426 | 11/1993 | Japan . |

OTHER PUBLICATIONS

T. B. Massalski, "Binary Alloy Phase Diagrams," American Society for Metals, Metals Park, Ohio, vol. 1, pp. 91–92, 1986.

Patent Abstracts of Japan, vol. 16, No. 544 (C–1004) Nov. 13, 1992.

*Primary Examiner*—David A. Simmons
*Assistant Examiner*—Robert R. Koehler
*Attorney, Agent, or Firm*—Finnegan, Henderson, Farabow, Garrett & Dunner

[57] ABSTRACT

An aluminum alloy powder for sliding members includes Fe in an amount of from 0.5 to 5.0% by weight, Cu in an amount of from 0.6 to 5.0% by weight, B in an amount of from 0.1 to 2.0% by weight and the balance of Al. An aluminum alloy includes a matrix made from the aluminum alloy powder and at least one member dispersed, with respect to whole of the matrix taken 100% by weight, in the matrix, and selected from the group consisting of B in an amount of from 0.1 to 5.0% by weight, boride in an amount of from 1.0 to 15% by weight and iron compound in an amount of from 1.0 to 15% by weight, and thereby it exhibits the tensile strength of 400 MPa or more. The aluminum alloy powder and the aluminum alloy are suitable for making sliding members like valve lifters for automobiles.

41 Claims, 3 Drawing Sheets

| | COMPOSITION (%) | | S. WEAR (μm) | M. M. WEAR (μm) |
|---|---|---|---|---|
| | MATRIX | ADDITIVE | 5 10 15 20 25 | 5 10 15 20 25 |
| Ex. 7 | Al−1Fe−4.5Cu −1.5Mg | $5TiB_2$ | | |
| Ex. 9 | Al−0.5Fe−4.2Cu−1.5Mg | 5FeB | | |
| Ex.13 | Al−3Fe−3Cu−3Ni−0.57B | 3FeB | | |
| Ex.30 | Al−3Fe−3Cu−3Ni−0.57B | 3 B | | |
| C.E.1 | Al−3Fe−3Cu−10Ni−8Si−1Zr−1Ti | — | (68) (66) | |
| C.E.3 | Al−3Fe−3Cu−10Ni−0.5Si−1Zr−1Ti | 3SiC | | |
| C.E.4 | Al−5Fe−3Cu−3Ni−0.7Zr−1Mo−1.4Mg | $10Al_2O_3$ | | |
| C.E.5 | Al−3Fe−3Cu−3Ni−0.7Zr−1.5Mg | $5Al_2O_3$ | | |

(NOTE) S. WEAR: SELF-WEAR AMOUNT (LIFTER)
M. M. WEAR: MATING MEMBER WEAR AMOUNT (HEAD)

FIG. 2

| | COMPOSITION (%) | | S. WEAR (μm) | M. M. WEAR (μm) |
|---|---|---|---|---|
| | MATRIX | ADDITIVE | 5 10 15 20 25 | 5 10 15 20 25 |
| Ex. 7 | Al−1Fe−4.5Cu−1.5Mg | $5TiB_2$ | | |
| Ex. 9 | Al−0.5Fe−4.2Cu−1.5Mg | 5FeB | | |
| Ex.13 | Al−3Fe−3Cu−3Ni−0.57B | 3FeB | | |
| Ex.30 | Al−3Fe−3Cu−3Ni−0.57B | 3 B | | |
| C.E.1 | Al−3Fe−3Cu−10Ni−8Si−1Zr−1Ti | — | (68) (66) | |
| C.E.3 | Al−3Fe−3Cu−10Ni−0.5Si−1Zr−1Ti | 3SiC | | |
| C.E.4 | Al−5Fe−3Cu−3Ni−0.7Zr−1Mo−1.4Mg | $10Al_2O_3$ | | |
| C.E.5 | Al−3Fe−3Cu−3Ni−0.7Zr−1.5Mg | $5Al_2O_3$ | | |

(NOTE) S. WEAR: SELF-WEAR AMOUNT (LIFTER)
M. M. WEAR: MATING MEMBER WEAR AMOUNT (HEAD)

FIG. 3

| | COMPOSITION (%) | | S. WEAR (μm) | M. M. WEAR (μm) |
|---|---|---|---|---|
| | MATRIX | ADDITIVE | 5 10 15 20 25 | 5 10 15 20 25 |
| Ex.22 | Al−0.5Fe−4.2Cu −1.5Mg | 5FeB | | |
| Ex.24 | Al −3Fe−3Cu−3Ni−0.35B | $3Fe_2P$ | | |
| Ex.25 | Al−3Fe−3Cu−3Ni−0.57B | 3FeB | | |
| C.E.1 | Al−3Fe−3Cu−10Ni−8Si−1Zr−1Ti | — | (68) (66) | |
| C.E.3 | Al−3Fe−3Cu−10Ni−0.5Si−1Zr−1Ti | 3SiC | | |
| C.E.4 | Al−5Fe−3Cu−3Ni−0.7Zr−1Mo−1.4Mg | $10Al_2O_3$ | | |
| C.E.5 | Al−3Fe−3Cu−3Ni−0.7Zr−1.5Mg | $5Al_2O_3$ | | |

(NOTE) S. WEAR: SELF-WEAR AMOUNT (LIFTER)
M. M. WEAR: MATING MEMBER WEAR AMOUNT (HEAD)

ALUMINUM ALLOY POWDER FOR SLIDING MEMBERS AND ALUMINUM ALLOY THEREFOR

BACKGROUND OF THE INVENTION

FIELD OF THE INVENTION

The present invention relates, to an aluminum alloy powder for sliding members and an aluminum alloy therefor which exhibit such high strength and wear resistance that they are applicable to sliding members of machines such as engines and oil pumps, and at the same time which exhibit extremely low aggressiveness against mating parts, particularly against the mating parts made from aluminum alloys, during sliding operation therewith.

When aluminum alloys and steels are slid or aluminum alloys are slid against each other, the aluminum alloys have been known that they are more likely to be seized than steels. On the other hand, in order to reduce the weight of the engines and the oil pumps, their component parts are often made from the aluminum alloys. Accordingly, there arises the engineering desire to slide the component parts made from the aluminum alloys against each other.

However, as mentioned earlier, the aluminum alloys are seized and worn with ease even under low loads. Consequently, even if the component parts are made from the aluminum alloys and put into practical applications, they are applied to sliding operation under extremely low loads, or either of them is subjected to surface treatment such as plating and thermal spraying.

In order to solve the aforementioned problems of the aluminum alloys, in Japanese Unexamined Patent Publication (KOKAI) No. 55-24,949, Japanese Unexamined Patent Publication (KOKAI) No. 55-97,447, Japanese Unexamined Patent Publication (KOKAI) No. 59-59,855 and Japanese Unexamined Patent Publication (KOKAI) No. 2-70,036, there are proposed to add a solid lubricant, such as graphite, molybdenum disulfide and lead, to an aluminum alloy, and to sinter the mixture, thereby improving the sliding property of the resulting aluminum alloys.

Moreover, in Japanese Unexamined Patent Publication (KOKAI) No. 1-56,844, Japanese Unexamined Patent Publication (KOKAI) No. 2-129,338, Japanese Unexamined Patent Publication (KOKAI) No. 2-194,135 and Japanese Unexamined Patent Publication (KOKAI) No. 3-264,636, there are proposed to add ceramic particles, such as alumina, silicon carbide, zirconium dioxide, aluminum composite oxide and aluminum nitride, and to sinter the mixture, thereby improving the sliding property of the resulting aluminum alloy-based composite materials.

However, the engineering attempts set forth in the publications cannot fully improve the sliding property and wear resistance of the resulting aluminum alloys and aluminum alloy-based composite materials, and accordingly a further improvement has been longed for. In addition, these attempts may sometimes degrade the mechanical strength and machinability of the aluminum alloys and the like.

SUMMARY OF THE INVENTION

It is therefore an object of the present invention to provide, without carrying out the surface treatment (e.g., the plating and the thermal spraying), an aluminum alloy powder for sliding members and an aluminum alloy therefor which exhibit little self-wear during sliding operation with mating members made from aluminum alloys, and which hardly wear the mating members.

The present inventors were successfully completed a heat resistant aluminum alloy powder and aluminum alloy which are also superb in strength and sliding property, and they filed a Japanese Patent Application No. 4-96,520 therefor. The aluminum alloy powder and aluminum alloy can be produced by adding at least one member selected from the group consisting of boron (B) and a graphite powder to a heat resistant aluminum alloy powder and aluminum alloy consisting essentially of at least one element selected from the group consisting of Si, Ni, Fe and Cu, and the balance of Al.

The present invention was developed based on the finding that aluminum alloy powders and aluminum alloys containing B were exceptionally good in sliding property, finding which had been acquired during the development of the aforementioned heat resistant aluminum alloy powder and aluminum alloy.

Accordingly, the present inventors made and evaluated a large variety of prototype aluminum alloy powders and aluminum alloys by adding B and a graphite powder to the aforementioned heat resistant aluminum alloy powder and aluminum alloy, thereby successfully completing an aluminum alloy powder and aluminum alloy for sliding members according to the present invention.

The present aluminum alloy powder for sliding members consists essentially of Fe in an amount of from 0.5 to 5.0% by weight, Cu in an amount of from 0.6 to 5.0% by weight, B in an amount of from 0.1 to 2.0% by weight, and the balance of Al.

The present aluminum alloy for sliding members having good seizure and wear resistance consists essentially of a matrix of an aluminum alloy which includes Fe in an amount of from 0.5 to 5.0% by weight, Cu in an amount of from 0.6 to 5.0% by weight and the balance of Al, and at least one member which is dispersed, with respect to whole of the matrix taken as 100% by weight, in the matrix, and which is selected from the group consisting of B in an amount of from 0.1 to 5.0% by weight, boride in an amount of from 1.0 to 15% by weight and iron compound in an amount of from 1.0 to 15% by weight. It exhibits a tensile strength of 400 MPa or more at room temperature.

Moreover, the present aluminum alloy for sliding members having good seizure and wear resistance can consist essentially of a matrix of an aluminum alloy which includes Fe in an amount of from 0.5 to 5.0% by weight, Cu in an amount of from 0.6 to 5.0% by weight, B in an amount of from 0.1 to 2.0% by weight and the balance of Al, and at least one member which is dispersed, with respect to whole of the matrix taken as 100% by weight, in the matrix, and which is selected from the group consisting of B in an amount of from 0.1 to 5.0% by weight, boride in an amount of from 1.0 to 15% by weight and iron compound in an amount of from 1.0 to 15% by weight. Likewise, it exhibits a tensile strength of 400 MPa or more at room temperature. In this modified present aluminum alloy, the boron included in the matrix is dissolved in the matrix in a form of the simple substance.

The present aluminum alloy powder can be produced by melting an alloying raw material having the aforementioned predetermined composition and followed by atomizing the molten alloying raw material.

The present aluminum alloy can be produced by alloying the present aluminum alloy powder with at least one dispersant member selected from the group consisting of B, boride and iron compound by means of sintering. Here, B can be added to the present aluminum alloy powder when carrying out the sintering, or it can be included in the present aluminum alloy powder in advance.

For instance, the present aluminum alloy can be produced as follows. The present aluminum alloy powder is poured into an aluminum can with at least one dispersant member selected from the group consisting of B, boride and iron compound. The canned powders are degased preliminarily, they are then extruded, and finally they are forged into the present aluminum alloy.

The content ranges of the elements and the members, constituting the present aluminum alloy powder and the present aluminum alloy, will be hereinafter described along with the operations thereof and the reasons for the limitations. Unless otherwise specified, the percentages hereinafter mean percentages by weight.

Fe: Fe is included in the present aluminum alloy powder and aluminum alloy in the amount of from 0.5 to 5.0%. Fe is usually said that it is unpreferable to include Fe in aluminum alloy powders and aluminum alloys, and that Fe should be included therein in an amount of not more than 0.5%. However, according to the results of the experiments conducted by the present inventors, it was revealed that, when Fe is included therein in an amount of 0.5% or more, the resulting aluminum alloys can be improved in the strengths at room temperature and at elevated temperatures.

When Fe is included therein in an amount of less than 0.5%, the resulting aluminum alloys are improved less effectively in the strengths at room temperature and at elevated temperatures. When Fe is included therein in a large amount, for example in an amount of more than 5.0%, the resulting aluminum alloys are brittle because there arise intermetallic compounds like $FeAl_3$ contributing to the strengths improvement but being very brittle in a large amount. In addition, when Fe is included therein in such a large amount, the resulting aluminum alloys are degraded in plastic processability. Hence, Fe is included therein in the amount of from 0.5 to 5.0%, preferably in an amount of from 0.5 to 3.0%.

Cu: Cu is included in the present aluminum alloy powder and aluminum alloy in the amount of from 0.6 to 5.0%. Al—Cu alloy has been known as age-hardenable, thereby reinforcing the Al matrix. According to the results of the experiments conducted by the present inventors, it was found that, when Cu is included therein in an amount of 0.6% or more, the resulting aluminum alloys can be improved in the strength at room temperature. On the other hand, when Cu is included therein in an amount of more than 5.0%, the resulting aluminum alloys are degraded in the strength at elevated temperatures because coarse precipitates arise therein. Thus, Cu is included therein in the amount of from 0.6 to 5.0%, preferably in an amount of from 1.0 to 5.0%.

B: The present aluminum alloy powder includes B in the amount of from 0.1 to 2.0%. The present aluminum alloy includes B in the amount of from 0.1 to 5.0%.

When producing the present aluminum alloy powder by rapid quenching and solidifying process, aluminum alloy powders including B in an amount of more than the solubility limit at room temperature can be produced by setting the melting temperature higher so as to dissolve B in a larger content and thereafter by rapidly quenching. In the present aluminum alloy powder, it is preferred that B is in solid solution, namely it is included therein in a form of the simple substance. It is possible to verify whether B is in solid solution or not by using a TEM (i.e., transmission electron microscope) or the like. However, when preparing aluminum alloy powders by rapid quenching and solidifying process, if molten aluminum alloys simultaneously including the other elements like Zr, B is likely to form boride with the other elements. Accordingly, it is unpreferable to make aluminum alloy powders from such molten aluminum alloys.

In particular, B can be dissolved in molten aluminum alloys in an amount of 0.22% and 1.7%, respectively, at 730° C. and 1,100° C. Accordingly, when the present aluminum alloy powder is produced by rapid quenching and solidifying process, it is necessary to prepare molten aluminum alloys whose temperature is raised to 1,100° C. or more. As a result, in actual applications, B is included in the present aluminum alloy powder in an amount of 2.0% or less. On the other hand, when B is included in aluminum alloy powders in an amount of less than 0.1%, the aluminum alloys resulting from such aluminum alloy powders are hardly improved in sliding property. Therefore, B is included in the present aluminum alloy powder in the amount of from 0.1 to 2.0%, preferably in an amount of from 0.1 to 1.0%. The present aluminum alloy powder thus produced is made into the present aluminum alloy by sintering process.

As B is included more in the present aluminum alloy powder, the resulting aluminum alloys tend to be improved in sliding characteristic. When B is included in an amount of less than 0.1% therein, the resulting aluminum alloys are improved less effectively in sliding characteristic. When B is included therein in an amount of more than 5.0% in a form of particles, the resulting aluminum alloys are deteriorated in strength and toughness. Hence, B is included in the present aluminum alloy in the amount of from 0.1 to 5.0%, preferably in an amount of from 0.1 to 3.0%.

Moreover, when the present aluminum alloy is produced by first preparing the present aluminum alloy powder, thereafter by mixing it with boron particles and finally by extruding the mixture, it is possible to include B in a larger content because there is no limitation on the dissolving temperature. However, as earlier mentioned, the aluminum alloys including B in the amount of more than 5.0% are degraded in strength and toughness. Thus, it is unpreferable to include B therein in the amount of more than 5.0%.

In addition, when preparing the present aluminum alloy by sintering as aforementioned, B can be added to the present aluminum alloy powder, or it can be included in the present aluminum alloy powder in advance.

At least one of the dispersant members: At least one dispersant member selected from the group consisting of boride and iron compound is dispersed, with respect to whole of the aforementioned Al matrix containing Fe, Cu and B and taken as 100% by weight, in the Al matrix. The boride is dispersed therein in the amount of from 1.0 to 15% by weight based on the Al matrix. The iron compound is dispersed therein in the amount of from 1.0 to 15% by weight based on the Al matrix. The boride and iron compound are additives which can improve the resulting present aluminum alloy in terms of sliding property.

The boride can be aluminum boride such as $AlB_2$ and $AlB_{12}$, chromium boride such as CrB and $CrB_2$, magnesium boride such as $MgB_2$, manganese boride such as MnB and $MnB_2$, molybdenum boride such as MoB and $MoB_2$, nickel boride such as NiB and $Ni_4B_3$, titanium boride such as $TiB_2$, vanadium boride such as $VB_2$ and $V_3B_2$, tungsten boride such as WB and $W_2B_5$, zirconium boride such as $ZrB_2$ and $ZrB_{12}$, and iron boride such as FeB and $Fe_2B$.

When the boride is dispersed, with respect to whole of the Al matrix taken as 100% by weight, in the Al matrix in an amount of less than 1.0%, the resulting aluminum alloys are improved less in sliding characteristic. Generally speaking, the boride has a hardness as high as that of diamond, e.g., 1,500 to 3,500 in Hv, virtually. Accordingly, when the boride is dispersed in the Al matrix in a large amount, the resulting aluminum alloys are adversely affected in terms of machinability and aggressiveness against mating parts. In the present aluminum alloy, considering the actual applicability of the resulting aluminum alloys, the boride is dispersed, with respect to whole of the A1 matrix taken as 100% by weight, in the Al matrix in the amount of from 1.0 to 15%, preferably in an amount of from 1.0 to 10%.

The iron compound can be iron oxide like $Fe_2O_3$, iron carbide like $Fe_3C$, iron nitride like $Fe_4N$, iron phosphide like $Fe_2P$, and iron boride like as FeB and $Fe_2B$.

When the iron compound is dispersed, with respect to whole of the Al matrix taken as 100% by weight, in the Al matrix in an amount of less than 1.0%, the resulting aluminum alloys are improved less in sliding characteristic. Generally speaking, the iron compound has a hardness, e.g., 700 to 2,200 in Hv, lower than that of diamond or boride, but the hardness is considerably higher than that of the Al matrix, e.g., 100 to 200 in Hv. Similarly to the boride, when the iron compound is dispersed in the Al matrix in a large amount, the resulting aluminum alloys are adversely affected in terms of machinability and aggressiveness against mating parts. In the present aluminum alloy, considering the actual applicability of the resulting aluminum alloys, the iron compound is dispersed, with respect to whole of the Al matrix taken as 100% by weight, in the Al matrix in the amount of from 1.0 to 15%, preferably in an amount of from 1.0 to 10%.

Moreover, it is preferred that the boride and iron compound have an average particle diameter $D_{50}$ of from 2.0 to 10 micrometers. When they have an average particle diameter of less than 2.0 micrometers, it is difficult to uniformly disperse them in the Al matrix. When they have an average particle diameter of more than 10 micrometers, similarly to the case where they are dispersed in the Al matrix in the amount of more than 15%, the resulting aluminum alloys are degraded in machinability and are heavily aggressive against mating parts.

Mg: In addition to Fe, Cu and B, the present aluminum alloy powder and aluminum alloy can further include Mg in the amount of from 0.5 to 5.0%. It has been known that the inclusion of Mg, similarly to the inclusion of Cu, strengthens the Al matrix and contributes to enhancing the strength. When Mg is included in an amount of less than 0.5%, the resulting aluminum alloys are scarcely improved in strength. On the other hand, when Mg is included in an amount of more than 5.0%, not only the resulting aluminum alloys are scarcely improved in strength, but also they are deteriorated in toughness. Hence, Mg is included in the present aluminum alloy powder and aluminum alloy in the amount of from 0.5 to 5.0%, preferably in an amount of from 0.5 to 3.0%.

Ni: In addition to Fe, Cu and B, the present aluminum alloy powder and aluminum alloy can further include Ni in the amount of from 2.0 to 10%. Ni produces intermetallic compounds, such as $NiAl_3$, NiAl and $Ni_2Al_3$, together with Al. These intermetallic compounds are stable at high temperatures, and they contribute to the wear resistance and the high temperature strength of the resulting aluminum alloys. Particularly, the $NiAl_3$ intermetallic compound is less hard but tougher than the other intermetallic compounds, e.g., NiAl and $Ni_2Al_3$. When Ni is included therein in an amount of 2.0% or more, there arises the precipitation of $NiAl_3$ intermetallic compound in the resulting aluminum alloys. However, when Ni is included therein in an amount of more than 10%, the resulting aluminum alloys are brittle and exhibit a small elongation at ordinary temperature. For instance, when products are made from such aluminum alloys including Ni in the amount of more than 10%, the products are good in terms of high temperature strength and wear resistance, but they are poor in terms of machinability or the like so that they cannot be put into actual applications with ease. Thus, Ni is included therein in the amount of from 2.0 to 10%, preferably in an amount of from 2.0 to 7.0%, further preferably in an amount of from 2.0 to 5.7%.

Si: In addition to Fe, Cu and B, the present aluminum alloy powder and aluminum alloy can further include Si in the amount of from 3.0 to 20%. It has been known that aluminum alloys with primary Si crystals dispersed therein, e.g., A390 alloy, are good in high temperature strength and wear resistance.

In the case that products are made by casting molten aluminum alloys including Si in an amount of 11.3% or more, coarse primary Si crystals are formed therein. As a result, when such products are used to make sliding parts, they attack their mating component part aggressively. Moreover, they are considerably poor in terms of machinability and exhibit a very small elongation. Hence, they are not practical from the production engineering viewpoint, e.g., the cracks or the like, during the processing, and they might be even cracked during the service as component parts. However, in the case that aluminum alloys are produced by rapid quenching and solidifying powder metallurgy process, the aluminum alloys can be obtained in which the fine primary Si crystals are formed even when Si is included therein in an amount of up to 20%.

On the other hand, when Si is included therein in an amount of less than 3.0%, the resulting aluminum alloys are not improved in high temperature strength and wear resistance to such an extent that they can be put into actual applications. Further, when Si is included therein in an amount of more than 20% and the resulting aluminum alloys are processed into products even by rapid quenching and solidifying powder metallurgy process, the coarse primary Si crystals are unpreferably formed in the products. Therefore, Si is included therein in the amount of from 3.0 to 20%, preferably in an amount of from 3.0 to 15%.

As having been described so far, the present aluminum alloy powder for sliding members includes Fe in the amount of from 0.5 to 5.0% by weight, Cu in the amount of from 0.6 to 5.0% by weight, B in the amount of from 0.1 to 2.0% by weight and the balance of Al. The present aluminum alloy for sliding members includes the Al alloy matrix, containing Fe in the amount of from 0.5 to 5.0% by weight, Cu in the amount of from 0.6 to 5.0% by weight and balance of Al, and at least one member dispersed, with respect to whole of the Al alloy matrix taken 100% by weight, in the Al alloy matrix, and selected from the group consisting of B in the amount of from 0.1 to 5.0% by weight, boride in the amount of from 1.0 to 15% by weight and iron compound in the amount of from 1.0 to 15% by weight, and thereby the present aluminum alloy exhibits the tensile strength of 400 MPa or more. As a result, when making sliding members like valve lifters for automobiles from the present aluminum alloy powder or aluminum alloy, the resulting sliding members exhibit superb seizure and wear resistance even in sliding operations with mating members made from aluminum alloys.

As hereinafter verified, even when plate-shaped test specimens made from the present aluminum alloy powder or aluminum alloy are slid on mating members made from aluminum alloys, they exhibit less self-wear amount and they scarcely wear the mating members. Further, iron-based materials have a higher hardness than aluminum-based materials and they are less likely to adhere. Thus, when the plate-shaped test specimens made from the present aluminum alloy powder or aluminum alloy are slid on mating members made of iron-based materials, it is apparent that they exhibit much more favorable wear resistance.

There have been widely used additives like SiC and $Al_2O_3$. It has been known that aluminum alloys including such additives are hard to machine. In fact, as set forth below, when making valve lifters from comparative aluminum alloys including the SiC and $Al_2O_3$, the valve lifters made from the comparative aluminum alloys were unfavorable in terms of dimensional accuracy and they were stained in black on their machined surfaces. On the other hand, valve lifters made from the present aluminum alloy powder or aluminum alloy were machined with ease relatively by using ordinary cutting tools, they exhibited satisfactory dimensional accuracy, and they were little stained in black on their machined surfaces.

Moreover, compared to the conventional aluminum alloys subjected to the surface treatment such as plating and thermal spraying, the present aluminum alloy powder and aluminum alloy are remarkably less expensive.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 2 is a column chart which illustrates the wear resistance of valve lifters for a 4,000 c.c. displacement automobile engine, valve lifters which were made from the preferred embodiments of the present aluminum alloy powder; and FIG. 3 is a column chart which illustrates the wear resistance of valve lifters for a 4,000 c.c. displacement automobile engine, valve lifters which were made from the other preferred embodiments of the present aluminum alloy powder.

DETAILED DESCRIPTION OF THE PREFERRED EMBODIMENTS

Figure 1:
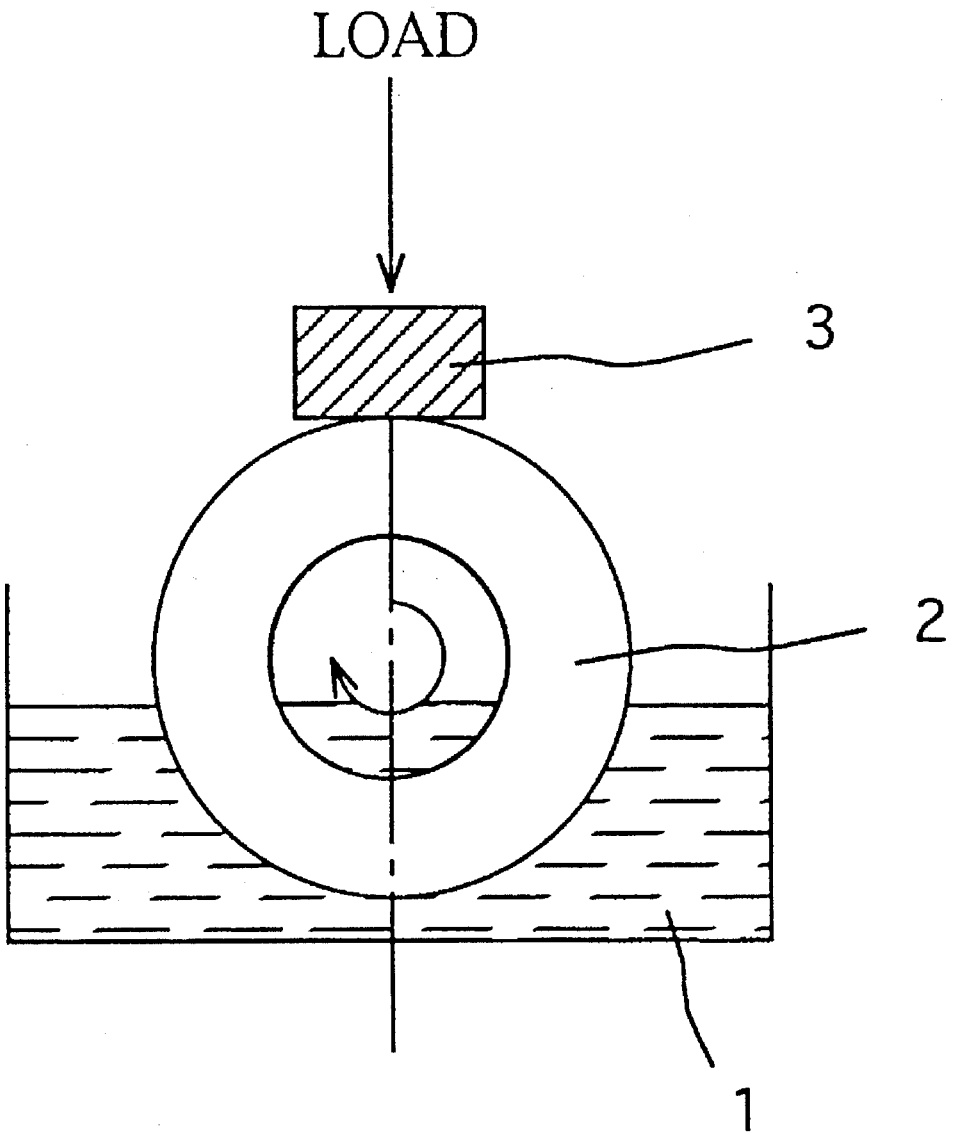
FIG. 1 is a schematic illustration on how an wear test was carried out in order to examine the wear resistance of plate-shaped test specimens which were made from the preferred embodiments of the present aluminum alloy powder.

Having generally described the present invention, a further understanding can be obtained by reference to the specific preferred embodiments which are provided herein for purposes of illustration only and are not intended to limit the scope of the appended claims.

First Preferred Embodiments

The First Preferred Embodiments of the present aluminum alloy will be hereinafter described with reference to Tables 1 and 2 below, along with comparative aluminum alloys. First of all, the following molten metals were prepared: 13 molten metals of matrices according to the First Preferred Embodiments of the present aluminum alloy having compositions designated with Ex. 1–13 (hereinafter referred to as the "matrices of Ex. 1–13") in Tables 1 and 2; and 5 molten metals of matrices according to Comparative Examples having compositions designated with C.E. 1–5 (hereinafter referred to as the "matrices of C.E. 1–5") therein.

TABLE 1

| | COMPOSITION (%) | | R.T. | | 150° C. | | | WEAR TEST RESULTS | |
|---|---|---|---|---|---|---|---|---|---|
| | MATRIX | ADDITIVE | T.S. | δ | T.S. | Y.S. | δ | S. WEAR | M.M. WEAR |
| Ex. 1 | Al—5Fe—3Cu—3Ni—0.7Zr—8Si—1.5Mg | 3NiB | 552 | 0.5 | 480 | 413 | 4.5 | 2.6 | 1.6 |
| Ex. 2 | Al—5Fe—3Cu—3Ni—0.7Zr—8Si—1.5Mg | $3TiB_2$ | 571 | 0.4 | 492 | 432 | 2.7 | 3.5 | 0.7 |
| Ex. 3 | Al—5Fe—3Cu—3Ni 0.7Zr—8Si—1.5Mg | $3MgB_2$ | 567 | 0.4 | 492 | 440 | 2.1 | 3.0 | 1.1 |
| Ex. 4 | Al—3Fe—3Cu—5Ni—0.7Zr—1.5Mg | 3FeB | 608 | 2.2 | 476 | 421 | 6.0 | 1.5 | 1.6 |
| Ex. 5 | Al—3Fe—3Cu—5Ni—0.7Zr—1.5Mg | 5FeB | 598 | 1.8 | 463 | 416 | 8.0 | 1.0 | 0 |
| Ex. 6 | Al—3Fe—3Cu—5Ni—0.7Zr—1.5Mg | 10FeB | 584 | 1.5 | 460 | 110 | 5.5 | 1.5 | 1.5 |
| C.E. 1 | Al—3Fe—3Cu—10Ni—8Si—1Zr—1Ti | — | 627 | — | 520 | 455 | 1.3 | 9.0 | 0 |
| C.E. 2 | Al—3Fe—3Cu—10Ni—0.5Si—1Zr—1Ti | — | 656 | 0.4 | 488 | 406 | 4.5 | 25.0 | 0 |
| C.E. 3 | Al—3Fe—3Cu—10Ni—0.5Si—1Zr—1Ti | 3SiC | 629 | — | 483 | 431 | 2.0 | 3.5 | 7.5 |
| C.E. 4 | Al—5Fe—3Cu—3Ni—0.7Zr—1Mo—1.4Mg | $10Al_2O_3$ | 577 | 1.2 | 491 | 450 | 3.5 | 2.0 | 13.5 |
| C.E. 5 | Al—3Fe—3Cu—3Ni—0.7Zr—1.5Mg | $5Al_2O_3$ | 524 | 4.5 | 429 | 367 | 6.6 | 2.0 | 10.0 |

(Note)
R.T.: Room Temperature, T.S.: Tensile Strength (MPa), δ: Elongation (%), Y.S.: Yield Strength (MPa), S. Wear: Self-wear Amount (in μm), M.M. Wear: Mating Member Wear Amount (mg)

TABLE 2

| | COMPOSITION (%) | | R.T. | | 150° C. | | | WEAR TEST RESULTS | |
|---|---|---|---|---|---|---|---|---|---|
| | MATRIX | ADDITIVE | T.S. | δ | T.S. | Y.S. | δ | S. WEAR | M.M. WEAR |
| Ex. 7 | Al—1Fe—4.5Cu—1.5Mg | $5TiB_2$ | 531 | 4.2 | 421 | 375 | 5.8 | 0.4 | 0 |
| Ex. 8 | Al—1Fe—4.5Cu—1.5Mg | $5TiB_2$ | 546 | 4.0 | 418 | 370 | 6.0 | 2.0 | 1.4 |
| Ex. 9 | Al—0.5Fe—4.2Cu—1.5Mg | 5FeB | 575 | 2.7 | 483 | 416 | 5.5 | 0.8 | 0 |
| Ex. 10 | Al—0.5Fe—4.2Cu—1.5Mg | 5FeB | 580 | 2.5 | 485 | 408 | 5.7 | 0.5 | 0.4 |
| Ex. 11 | Al—3Fe—3Cu—3Ni—17Si | $3MgB_2$ | 500 | 1.5 | 381 | 308 | 5.3 | 1.8 | 1.9 |

TABLE 2-continued

| | COMPOSITION (%) | | R.T. | | 150° C. | | | WEAR TEST RESULTS | |
|---|---|---|---|---|---|---|---|---|---|
| | MATRIX | ADDITIVE | T.S. | δ | T.S. | Y.S. | δ | S. WEAR | M.M. WEAR |
| Ex. 12 | Al—3Fe—3Cu—3Ni—0.7Zr—1.5Mg | 2B | 557 | 4.4 | 453 | 390 | 7.5 | 1.0 | 0 |
| Ex. 13 | Al—3Fe—3Cu—3Ni—0.57B | 3Feb | 520 | 9.0 | 266 | 212 | 16.1 | 0.4 | 0 |
| Ex. 30 | Al—3Fe—3Cu—3Ni—0.57B | 3B | 425 | 9.3 | 270 | 225 | 15.9 | 0.3 | 0 |
| C.E. 1 | Al—3Fe—3Cu—10Ni—8Si—1Zr—1Ti | — | 627 | — | 520 | 455 | 1.3 | 9.0 | 0 |
| C.E. 2 | Al—3Fe—3Cu—10Ni—0.5Si—1Zr—1Ti | — | 656 | 0.4 | 488 | 406 | 4.5 | 25.0 | 0 |
| C.E. 3 | Al—3Fe—3Cu—10Ni—0.5Si—1Zr—1Ti | 3SiC | 629 | — | 483 | 431 | 2.0 | 3.5 | 7.5 |
| C.E. 4 | Al—5Fe—3Cu—3Ni—0.7Zr—1Mo—1.4Mg | $10Al_2O_3$ | 577 | 1.2 | 491 | 450 | 3.5 | 2.0 | 13.5 |
| C.E. 5 | Al—3Fe—3Cu—3Ni—0.7Zr | $5Al_2O_3$ | 524 | 4.5 | 429 | 367 | 6.6 | 2.0 | 10.0 |

(Note)
R.T.: Room Temperature, T.S.: Tensile Strength (MPa), δ: Elongation (%), Y.S.: Yield Strength (MPa), S. Wear: Self-wear Amount (in μm), M.M. Wear: Mating Member Wear Amount (mg)

Then, the molten matrices of Ex. 1–13 and the molten matrices of C.E. 1–5 were pulverized by atomizing process. Thereafter, the resulting powders were classified with a minus 100 mesh sieve, respectively, thereby preparing the matrix powders of Ex. 1–13 and the matrix powders of C.E. 1–5.

When preparing the matrix powder of Ex. 13 set forth in Table 2, the molten matrix of Ex. 13 was pulverized by atomizing process at 1,150° C. which was set slightly higher than the usual temperature therefor. The boron content in the matrix powder of Ex. 13 was obtained by analyzing the matrix powder after carrying out the atomizing process.

The matrix powders of Ex. 1–13 and a predetermined amount of the additives, e.g., borides or boron, set forth in Tables 1 and 2 were mixed with a mixer, thereby preparing 13 mixed powders according to the First Preferred Embodiments of the present aluminum alloy. Likewise, the matrix powders of C.E. 3–5 and a predetermined amount of the additives, e.g., silicon carbide or alumina, set forth in Tables 1 and 2 were mixed with a mixer, thereby preparing 3 mixed powders according to the Comparative Examples. In Tables 1 and 2, the numbers put in front of the additives are the weight percentages of the additives with respect to whole of the matrix powders according to the First Preferred Embodiments of the present aluminum alloy, or the matrix powders according to the Comparative Examples, taken as 100% by weight.

The 13 mixed powders of the First Preferred Embodiments of the present aluminum alloy designated with Ex. 1–13, the 2 matrix powders of the Comparative Examples designated with C.E. 1–2, and the 3 mixed powders of Comparative Examples designated with 3–5 were poured in a mold, respectively, and they were vacuum hot pressed preliminarily into a preform having a diameter of 30 mm and a length of 80 mm, respectively, with a pressure of 3 ton/cm$^2$ at 350° C. in vacuum. Then, the preforms were heated at 450° C. for 30 minutes, and they were hot-extruded at an extrusion ratio of 10, thereby preparing 13 rod-shaped test specimens according to the First Preferred Embodiments of the present aluminum alloy having the compositions designated with Ex. 1–13 and having a diameter of 10 mm and a length of 60 mm (hereinafter referred to as the "rod-shaped test specimens of Ex. 1–13"), and 5 rod-shaped test specimens according to the Comparative Examples having the compositions designated with C.E. 1–5 and having the identical configuration (hereinafter referred to as the "rod-shaped test specimens of C.E. 1–5" ). Further, these rod-shaped test specimens were processed into a dumbbell-shaped test specimen for a tensile test, respectively, and the resulting 18 dumbbell-shaped test specimens were subjected to a tensile test. The dumbbell-shaped test specimen had a diameter of 3.5 mm and a length of 25 mm at the reduced section.

In addition, the 13 mixed powders of the First Preferred Embodiments of the present aluminum alloy designated with Ex. 1–13, the 2 matrix powders of the Comparative Examples designated with C.E. 1–2, and the 3 mixed powders of Comparative Examples designated with C.E. 3–5 were charged, respectively, in a mold, and they were hot-pressed at 450° C. with s pressure of 3 ton/cm$^2$ in vacuum, respectively. Then, the resulting molded bodies were machined, thereby preparing 13 plate-shaped test specimens according to the First Preferred Embodiments of the present aluminum alloy having the compositions designated with Ex. 1–13 and having a length of 6.35 mm, a width of 15.7 mm and a thickness of 10.1 mm (hereinafter referred to as the "plate-shaped test specimens of Ex. 1–13"), and 5 plate-shaped test specimens according to the Comparative Examples having the compositions designated with C.E. 1–5 and having the identical configuration (hereinafter referred to as the "plate-shaped test specimens of C.E. 1–5"). These plate-shaped test specimens were subjected to a wear test.

In the 13 mixed powders of the First Preferred Embodiments of the present aluminum alloy designated with Ex. 1–13, the additives added thereto, e.g., NiB, $TiB_2$, $MgB_2$, FeB and B, had an average particle diameter $D_{50}$ of 2.45 micrometers, 2.0–5.0 micrometers, 1.43 micrometers, 8.7 micrometers and 5.0 micrometers, respectively. In the 3 mixed powders of the Comparative Examples designated with C.E. 3–5, the additives added thereto, e.g., SiC and $Al_2O_3$, had an average particle diameter $D_{50}$ of 3.2 micrometers and 2.4 micrometers, respectively.

Tensile Strength Test

The rod-shaped test specimens of Ex. 1–13 and the rod-shaped test specimens of C.E. 1–5 were subjected to the tensile test in order to evaluate the mechanical characteristics thereof at room temperature and at 150 ° C., for example, their tensile strength and elongation at room temperature, and their tensile strength, yield strength and elongation at 150° C. The results of the tensile test are summarized in Tables 1 and 2.

As can be appreciated from Tables 1 and 2, all of the rod-shaped test specimens of Ex. 1–13 exhibited a tensile strength of more than 400 MPa at room temperature and a high tensile strength of from 266 to 492 MPa at 150° C. Thus, mechanical structures made from the First Preferred Embodiments of the present aluminum alloy can be expected to exhibit high strength at room temperature as well as at the elevated temperature of 150° C. to the fullest extent.

Wear Test

The plate-shaped test specimens of Ex. 1–13 and the plate-shaped test specimens of C.E. 1–5 were subjected to the wear test under oil lubrication. As illustrated in FIG. 1, in the wear test, an "LFW" testing machine filled with a lubricant 1 equivalent to the 5W-30 standard oil was employed, an AC2B aluminum alloy (as per JIS) was made into a ring-shaped mating member 2, and the plate-shaped test specimens 3 were pressed at a load of 15 kgf against the ring-shaped mating member 2 rotating at a speed of 160 rpm. After exposing the plate-shaped test specimens 3 to the wear condition for 30 minutes, they were examined for the wear depth (hereinafter referred to as a "self-wear amount") and the mating members 2 were examined for the absolute wear amount (hereinafter referred to as a "mating member wear amount"). The self-wear amount and the mating member wear amount were measured in units of micrometer and milligram, respectively. The results of the wear test are also summarized in Tables 1 and 2. The mechanical structures are required to exhibit a self-wear amount of 5.0 micrometers or less and a mating member wear amount of 2.0 milligrams or less.

All of the plate-shaped test specimens of Ex. 1–6 having a matrix composition and an additive of different kinds as set forth in Table 1 exhibited wear resistance which satisfied the aforementioned requirements on the self-wear amount and mating member wear amount. Among them, the plate-shaped test specimen of Ex. 5 with FeB added in the amount of 5% exhibited the best wear resistance.

Likewise, the plate-shaped test specimens of Ex. 7–13 having a matrix composition and an additive of different kinds as set forth in Table 2 exhibited wear resistance which was equivalent to those of the plate-shaped test specimens Ex. 1–6. Among them, the plate-shaped test specimens of Ex. 9 and 10 with FeB added in the amount of 5% exhibited the small self-wear amount stably. Further, the following plate-shaped test specimens exhibited the remarkably small self wear amount and the mating member wear amount of zero: the plate-shaped test specimens of Ex. 12 with boron added in the amount of 2%, and the plate-shaped test specimens of Ex. 13 comprised of the matrix including boron in the amount of 0.57% and with FeB added further therein in the amount of 3%.

On the other hand, the plate-shaped test specimens of C.E. 1 and 2 free from the additives did not wear the mating members, but they exhibited the considerably large self-wear amount. Moreover, SiC and $Al_2O_3$ are additives which have been used widely. However, the plate-shaped test specimens of C.E. 3–5 with such additives added exhibited the extremely large mating member wear amount of from 7.5 to 13.5 mg in spite of their small self-wear amounts.

In addition, test specimens of Ex. 30 were prepared from a matrix whose composition was set identical to that of Ex. 13 but in which B was dispersed instead of FeB, and they were subjected to the tensile test and the wear test. As a result, the test specimens of Ex. 30 were found to have strength characteristic and wear resistance which were virtually equivalent to those of Ex. 13.

Second Preferred Embodiment

Round bars having a diameter of 36 mm were made from the 3 mixed powders according to the First Preferred Embodiments of the present aluminum alloy having the composition designated with Ex. 7, 9 and 13 which made the test specimens exhibiting good results in the wear test. The round bars were prepared by the same process as the rod-shaped test specimens for the tensile strength test were prepared, and they were machined to valve lifters for a 4,000 c.c. displacement automobile engine (hereinafter referred to as the "valve lifters of Ex. 7, 9 and 13"). Similarly, the round bars were made from the 4 mixed powders according to the comparative aluminum alloys having the composition designated with C.E. 1, 3, 4 and 5, and they were machined to valve lifters having the identical configuration (hereinafter referred to as the "valve lifters of C.E. 1, 3, 4 and 5").

Each of the resulting 7 valve lifters were installed on a 4,000 c.c. displacement automobile engine. The engines were operated at a speed of 6,500 rpm for 200 hours, thereby carrying out a durability test onto the 7 valve lifters. After the durability test, the valve lifters were measured for a wear amount on the outer periphery (hereinafter referred to as a "self-wear amount") in units of micrometer, and the lifter holes of the heads made from an AC2B aluminum alloy (as per JIS) were measured for a wear amount (hereinafter referred to as a "mating member wear amount") in units of micrometer. The results of these measurements are illustrated in FIG. 2. The valve lifter is required to exhibit a self-wear amount of 10.0 micrometers or less, and the lifter hole of the head is also required to exhibit a mating member wear amount of 10.0 micrometers or less.

As can be seen from FIG. 2 illustrating the results of the durability test, the valve lifters of Ex. 7, 9 and 13 exhibited the following superior wear resistance: Both of the valve lifters of Ex. 7 and 9 with $TiB_2$ and FeB added respectively exhibited the wear resistance which satisfied the aforementioned requirements on the self-wear amount and mating member wear amount. In particular, the valve lifters of Ex. 13 comprised of the matrix including micro-fined boron in the amount of 0.57% and with FeB added further therein in the amount of 3% exhibited the self-wear amount and the mating member wear amount of 4.0 micrometers or less, and they thus exhibited the best wear resistance.

On the other hand, the valve lifters of C.E. 1 free from the additives exhibited a mating member wear amount of 7.8 micrometers or less satisfying the requirement, but they exhibited a remarkably large self-wear amount of from 66 to 68 micrometers. Moreover, the valve lifters of C.E. 3, 4 and 5 with SiC and $Al_2O_3$ added exhibited a self-wear amount of from 2.0 to 7.0 micrometers satisfying the requirement, but they exhibited a considerably large mating member wear amount of from 16 to 26 micrometers.

The durability test revealed that the valve lifters according to the Second Preferred Embodiments of the present aluminum alloy and the Comparative Examples exhibited wear resistance behaviors which were similar to those revealed by the wear resistance test to which the plate-shaped test specimens according to the First Preferred Embodiments of the present aluminum alloy and the Comparative Examples were subjected.

In addition, valve lifters of Ex. 30 were prepared from a matrix whose composition was set identical to that of Ex. 13 but in which B was dispersed instead of FeB, and they were subjected to the durability test. As can be appreciated from FIG. 2, the valve lifters of Ex. 30 exhibited wear resistance which was comparable with that of Ex. 13.

Third Preferred Embodiments

The Third Preferred Embodiments of the present aluminum alloy will be hereinafter described with reference to Tables 3 and 4 below, also together with the aforementioned Comparative Examples. The Third Preferred Embodiments of the present aluminum alloy were produced in the same manner as the First Preferred Embodiments of the present aluminum alloy.

Namely, 12 molten metals of matrices according to the Third Preferred Embodiments of the present aluminum alloy having compositions designated with Ex. 14–25 (hereinafter referred to as the "matrices of Ex. 14–25") in Tables 3 and 4 were prepared. Then, the molten matrices of Ex. 14–25 were pulverized by atomizing process. Thereafter, the resulting powders were classified, respectively, in the same manner as the First Preferred Embodiments of the present aluminum alloy were classified, thereby preparing the matrix powders of Ex. 14–25.

In the same manner as the rod-shaped test specimens according to the First Preferred Embodiments of the present aluminum alloy were made, 12 rod-shaped test specimens according to the Third Preferred Embodiments of the present aluminum alloy having the composition designated with Ex. 14–25 (hereinafter referred to as the "rod-shaped test specimens of Ex. 14–25") were made from the 12 mixed powders of the Third Preferred Embodiments of the present aluminum alloy designated with Ex. 14–25. The rod-shaped test specimens of Ex. 14–25 were subjected to the tensile test.

TABLE 3

| | COMPOSITION (%) | | R.T. | | 150° C. | | | WEAR TEST RESULTS | |
|---|---|---|---|---|---|---|---|---|---|
| | MATRIX | ADDITIVE | T.S. | δ | T.S. | Y.S. | δ | S. WEAR | M.M. WEAR |
| Ex. 14 | Al—3Fe—3Cu—5Ni—0.7Zr—1.5Mg | 3FeB | 608 | 2.2 | 476 | 421 | 6.0 | 1.5 | 1.6 |
| Ex. 15 | Al—3Fe—3Cu—5Ni—0.7Zr—1.5Mg | 5FeB | 598 | 1.8 | 463 | 416 | 6.0 | 1.0 | 0 |
| Ex. 16 | Al—3Fe—3Cu—5Ni—0.7Zr—1.5Mg | 10FeB | 584 | 1.5 | 460 | 410 | 5.5 | 1.5 | 1.5 |
| Ex. 17 | Al—3Fe—3Cu—5Ni—1.5Mg | $3Fe_4N$ | 580 | 2.1 | 463 | 405 | 5.2 | 5.0 | 0 |
| Ex. 18 | Al—3Fe—3Cu—5Ni—1.5Mg | $5Fe_4N$ | 556 | 1.2 | 444 | 390 | 5.0 | 4.5 | 0 |
| Ex. 19 | Al—3Fe—3Cu—5Ni—1.5Mg | $10Fe_4N$ | 547 | 1.2 | 437 | 380 | 4.8 | 4.0 | 0 |
| C.E. 1 | Al—3Fe—3Cu—10Ni—8Si—1Zr—1Ti | — | 627 | — | 520 | 455 | 1.3 | 9.0 | 0 |
| C.E. 2 | Al—3Fe—3Cu—10Ni—0.5Si—1Zr—1Ti | — | 656 | 0.4 | 488 | 406 | 4.5 | 25.0 | 0 |
| C.E. 3 | Al—3Fe—3Cu—10Ni—0.5Si—1Zr—1Ti | 3SiC | 629 | — | 483 | 431 | 2.0 | 3.5 | 7.5 |
| C.E. 4 | Al—5Fe—3Cu—3Ni—0.7Zr—1Mo—1.4Mg | $10Al_2O_3$ | 577 | 1.2 | 491 | 450 | 3.5 | 2.0 | 13.5 |
| C.E. 5 | Al—3Fe—3Cu—3Ni—0.7Zr—1.5Mg | $5Al_2O_3$ | 524 | 4.5 | 429 | 367 | 6.6 | 2.0 | 10.0 |

(Note)
R.T.: Room Temperature, T.S.: Tensile Strength (MPa), δ: Elongation (%), Y.S.: Yield Strength (MPa), S. Wear: Self-wear Amount (in μm), M.M. Wear: Mating Member Wear Amount (mg)

TABLE 4

| | COMPOSITION (%) | | R.T. | | 150° C. | | | WEAR TEST RESULTS | |
|---|---|---|---|---|---|---|---|---|---|
| | MATRIX | ADDITIVE | T.S. | δ | T.S. | Y.S. | δ | S. WEAR | M.M. WEAR |
| Ex. 20 | Al—3Fe—3Cu—7Ni—0.7Zr—1.5Mg | $3Fe_2P$ | 676 | 2.2 | 515 | 473 | 7.4 | 3.4 | 0 |
| Ex. 21 | Al—3Fe—3Cu—7Ni—0.7Zr—1.5Mg | $3Fe_2P$ | 637 | 1.4 | 515 | 463 | 6.8 | 3.0 | 0 |
| Ex. 22 | Al—0.5Fe—4.2Cu—1.5Mg | 5FeB | 575 | 2.7 | 483 | 416 | 5.5 | 0.8 | 0 |
| Ex. 23 | Al—0.5Fe—4.2Cu—1.5Mg | 5FeB | 580 | 2.5 | 485 | 408 | 5.7 | 0.5 | 0.4 |
| Ex. 24 | Al—3Fe—3Cu—3Ni—0.35B | $3Fe_2P$ | 400 | 8.8 | 248 | 198 | 17.2 | 0.8 | 0 |
| Ex. 25 | Al—3Fe—3Cu—3Ni—0.57B | 3FeB | 420 | 9.0 | 266 | 212 | 16.1 | 0.4 | 0 |
| C.E. 1 | Al—3Fe—3Cu—10Ni—8Si—1Zr—1Ti | — | 627 | — | 520 | 455 | 1.3 | 9.0 | 0 |
| C.E. 2 | Al—3Fe—3Cu—10Ni—0.5Si—1Zr—1Ti | — | 656 | 0.4 | 488 | 406 | 4.5 | 25.0 | 0 |
| C.E. 3 | Al—3Fe—3Cu—10Ni—0.5Si—1Zr—1Ti | 3SiC | 629 | — | 483 | 431 | 2.0 | 3.5 | 7.5 |
| C.E. 4 | Al—5Fe—3Cu—3Ni—0.7Zr—1Mo—1.4Mg | $10Al_2O_3$ | 577 | 1.2 | 491 | 450 | 3.5 | 2.0 | 13.5 |
| C.E. 5 | Al—3Fe—3Cu—3Ni—0.7Zr—1.5Mg | $5Al_2O_3$ | 524 | 4.5 | 429 | 367 | 6.6 | 2.0 | 10.0 |

(Note)
R.T.: Room Temperature, T.S.: Tensile Strength (MPa), δ: Elongation (%), Y.S.: Yield Strength (MPa), S. Wear: Self-wear Amount (in μm), M.M. Wear: Mating Member Wear Amount (mg)

The matrix powders of Ex. 24 and 25 set forth in Table 4 were prepared in the same manner as that of Ex. 13 set forth in Table 2. Likewise, the boron contents in the matrix powders of Ex. 24 and 25 were obtained by analyzing the matrix powders after carrying out the atomizing process.

The matrix powders of Ex. 14–25 and a predetermined amount of the additives, e.g., iron compound, set forth in Tables 3 and 4 were mixed with a mixer, thereby preparing 12 mixed powders according to the Third Preferred Embodiments of the present aluminum alloy. Similarly to Tables 1 and 2, in Tables 3 and 4, the numbers put in front of the additives are the weight percentages of the additives with respect to whole of the matrix powders according to the Third Preferred Embodiments of the present aluminum alloy taken as 100% by weight.

In addition, in the same manner as the plate-shaped test specimens according to the First Preferred Embodiments of the present aluminum alloy were made, 12 plate-shaped test specimens according to the Third Preferred Embodiments of the present aluminum alloy (hereinafter referred to as the "plate-shaped test specimens of Ex. 14–25") were made from the 12 mixed powders of the Third Preferred Embodiments of the present aluminum alloy designated with Ex. 14–25. The plate-shaped test specimens of Ex. 14–25 were subjected to the wear test.

In the 12 mixed powders of the Third Preferred Embodiments of the present aluminum alloy designated with Ex. 14–25, the additives added thereto, e.g., FeB, $Fe_4n$ and $Fe_2P$, had an average particle diameter $D_{50}$ of 8.7 micrometers, 2.0–5.0 micrometers and 5.7 micrometers, respectively.

Tensile Strength Test

The rod-shaped test specimens of Ex. 14–25 were subjected to the tensile test, to which the rod-shaped test specimens of the First Preferred Embodiments were subjected, in order to evaluate the mechanical characteristics thereof at room temperature and at 150° C., for example, their tensile strength and elongation at room temperature, and their tensile strength, yield strength and elongation at 150° C. The results of the tensile test are summarized in Tables 3 and 4.

As can be appreciated from Tables 3 and 4, all of the rod-shaped test specimens of Ex. 14–25 exhibited a tensile strength of more than 400 MPa at room temperature and a high tensile strength of from 248 to 515 MPa at 150° C. Thus, mechanical structures made from the Third Preferred Embodiments of the present aluminum alloy can be expected to exhibit high strength at room temperature as well as at the elevated temperature of 150° C. to the fullest extent.

Wear Test

The plate-shaped test specimens of Ex. 14–25 were subjected to the wear test, to which the plate-shaped test specimens of the First Preferred Embodiments were subjected, under oil lubrication. The results of the wear test are also summarized in Tables 3 and 4.

All of the plate-shaped test specimens of Ex. 14–19 having a matrix composition and an additive of different kinds as set forth in Table 3 exhibited wear resistance which satisfied the aforementioned requirements on the self-wear amount and mating member wear amount. Among the plate-shaped test specimens of Ex. 14–16 with FeB added in the amount of 3%, 5% and 10%, the plate-shaped test specimens of Ex. 15 with FeB added in the amount of 5% exhibited the best wear resistance.

Likewise, the plate-shaped test specimens of Ex. 20–25 having a matrix composition and an additive of different kinds as set forth in Table 4 also satisfied the aforementioned requirements on the self-wear amount and mating member wear amount. In particular, the plate-shaped test specimens of Ex. 22 and 23 exhibited wear resistance which was equivalent to that of the plate-shaped test specimens Ex. 15. In other words, regardless of the matrix compositions, it is believed that the Third Preferred Embodiments of the present aluminum alloy with FeB added in the amount of 5% exhibit superb wear resistance.

Moreover, the following plate-shaped test specimens exhibited the remarkably small self wear amount and the mating member wear amount of zero: the plate-shaped test specimens of Ex. 24 and 25 comprised of the matrices including boron in the amount of 0.35% and 0.57% respectively and with $Fe_2P$ and FeB added further therein in the amount of 3% respectively.

Fourth Preferred Embodiment

In the same manner as the valve lifters of the Second Preferred Embodiments for the 4,000 c.c. displacement automobile engine were manufactured, valve lifters were made from the 3 mixed powders according to the Third Preferred Embodiments of the present aluminum alloy having the composition designated with Ex. 22, 24 and 25 which made the test specimens exhibiting good results in the wear test (hereinafter referred to as the "valve lifters of Ex. 22, 24 and 25").

The resulting 3 valve lifters were subjected to the durability test to which the valve lifters of the Second Preferred Embodiments were subjected, and they were examined for the self-wear amount and the mating member wear amount. The result of the examinations are illustrated in FIG. 3.

As can be seen from FIG. 3 illustrating the results of the durability test, the valve lifters of Ex. 22, 24 and 25 exhibited first-rate wear resistance which was equal to those of the valve lifters of Ex. 7, 9 and 13 according to the Second Preferred Embodiments. Specifically speaking, the valve lifters of Ex. 22 with FeB added in the amount of 5% exhibited wear resistance which satisfied the aforementioned requirements on the self-wear amount and mating member wear amount. Especially, the valve lifters of Ex. 24 and 25 comprised of the matrices including boron in the amount of 0.35% and 0.57% respectively and with $Fe_2P$ and FeB added further therein in the amount of 3% respectively exhibited further superb wear resistance, for example, the self-wear amount and the mating member wear amount of 5.0 micrometers or less respectively.

Having now fully described the present invention, it will be apparent to one of ordinary skill in the art that many changes and modifications can be made thereto without departing from the spirit or scope of the present invention as set forth herein including the appended claims.

What is claimed is:

1. An aluminum alloy powder for sliding members and produced by a rapid quenching and solidifying process, comprising:

Fe in an amount of from 0.5 to 5.0% by weight;

Cu in an amount of from 0.6 to 5.0% by weight;

B in an amount of from 0.1 to 2.0% by weight; and the balance of Al.

2. The aluminum alloy powder according to claim 1 wherein said Fe is present in an amount of from 0.5 to 3.0% by weight.

3. The aluminum alloy powder according to claim 1 wherein said Cu is present in an amount of from 1.0 to 5.0% weight.

4. The aluminum alloy powder according to claim 1 wherein said B is present in an amount of form 0.1 to 1.0% weight.

5. The aluminum alloy powder according to claim 1, wherein said B is present in elemental form.

6. The aluminum alloy powder according to claim 1 further including at least one element selected from the group consisting of Mg in an amount of from 0.5 to 5.0% by weight, Ni in an amount of from 2.0 to 10% by weight, Zr in an amount of from 0.5 to 2.0% by weight and Si in an amount of from 3.0 to 20% by weight.

7. The aluminum alloy powder according to claim 6 including said Mg in an amount of from 0.5 to 3.0% by weight.

8. The aluminum alloy powder according to claim 6 including said Ni in an amount of from 2.0 to 7.0% by weight.

9. The aluminum alloy powder according to claim 8 including said Ni in an amount of from 2.0 to 5.7% by weight.

10. The aluminum alloy powder according to claim 6 including said Si in an amount of from 3.0 to 15% by weight.

11. The aluminum alloy powder according to claim 1, further including at least one element selected from the group consisting of Ni in an amount of from 2 to less than 5.7% by weight (not inclusive), Si in an amount of from 3 to 5% by weight, Mg in an amount of from 0.5 to 5.0% by weight and Zr in an amount of from 0.5 to 2.0% by weight.

12. An aluminum alloy for sliding members having good seizure and wear resistance, comprising:

a matrix of an aluminum alloy including;

Fe in an amount of from 0.5 to 5.0% by weight;

Cu in an amount of from 0.6 to 5.0% by weight; and the balance of Al; and at least one member dispersed, with respect to whole of said matrix taken as 100% by weight, in said matrix, and selected from the group consisting of B in an amount of from 0.1 to 5.0% by weight, boride in an amount of from 1.0 to 15% by weight and iron compound in an amount of from 1.0 to 15% by weight;

the aluminum alloy exhibiting a tensile strength of 400 MPa or more at room temperature.

13. The aluminum alloy according to claim 12, wherein said matrix includes said Fe in an amount of from 0.5 to 3.0% by weight.

14. The aluminum alloy according to claim 12, wherein said matrix includes said Cu in an amount of from 1.0 to 5.0% weight.

15. The aluminum alloy according to claim 12, wherein said B is dispersed in said matrix in an amount of from 0.1 to 3.0% weight.

16. The aluminum alloy according to claim 12, wherein said B dispersed in said matrix takes a form of particles.

17. The aluminum alloy according to claim 12, wherein said matrix further includes at least one element selected from the group consisting of Mg in an amount of from 0.5 to 5.0% by weight, Ni in an amount of from 2.0 to 10% by weight, Zr in an amount of from 0.5 to 2.0% by weight and Si in an amount of from 3.0 to 20% by weight.

18. The aluminum alloy according to claim 17, wherein said matrix includes said Mg in an amount of from 0.5 to 3.0% by weight.

19. The aluminum alloy according to claim 17, wherein said matrix includes said Ni in an amount of from 2.0 to 7.0% by weight.

20. The aluminum alloy according to claim 19, wherein said matrix includes said Ni in an amount of from 2.0 to 5.7% by weight.

21. The aluminum alloy according to claim 17, wherein said matrix includes said Si in sn amount of from 3.0 to 15% by weight.

22. The aluminum alloy according to claim 12, wherein said boride is present as particles having an average particles diameter of from 2.0 to 10 micrometers.

23. The aluminum alloy according to claim 12, wherein said boride is at least one member selected from the group consisting of nickel boride, titanium boride, magnesium boride and iron boride.

24. The aluminum alloy according to claim 12, wherein said iron compound is present as particles having an average particle diameter of from 2.0 to 10 micrometers.

25. The aluminum alloy according to claim 12, wherein said iron compound is at least one member selected from the group consisting of iron boride, iron nitride and iron phosphide.

26. An aluminum alloy for sliding members having good seizure and wear resistance, comprising:

a matrix of an aluminum alloy including:

Fe in an amount of from 0.5 to 5.0% by weight;

Cu in an amount of from 0.6 to 5.0% by weight;

B in an amount of from 0.1 to 2.0% by weight; and the balance of Al; and particles of at least one member dispersed, with respect to whole of said matrix taken as 100% by weight, in said matrix, and selected from the group consisting of B in an amount of from 0.1 to 5.0% by weight, boride in an amount of from 1.0 to 15% by weight and iron compound in an amount of from 1.0 to 15% by weight;

the aluminum alloy exhibiting a tensile strength of 400 MPa or more at room temperature.

27. The aluminum alloy according to claim 26, wherein said matrix includes said Fe in an amount of from 0.5 to 3.0% by weight.

28. The aluminum alloy according to claim 26, wherein said matrix includes said Cu in an amount of from 1.0 to 5.0% weight.

29. The aluminum alloy according to claim 26, wherein said matrix includes said B in an amount of from 0.1 to 1.0% weight.

30. The aluminum alloy according to claim 26, wherein said B is dispersed in said matrix in an amount of from 0.1 to 3.0% weight.

31. The aluminum alloy according to claim 26, wherein said B included in said matrix is dissolved in said matrix.

32. The aluminum alloy according to claim 26, wherein said B dispersed in said matrix takes a form of particles.

33. The aluminum alloy according to claim 26, wherein said matrix further includes at least one element selected from the group consisting of Mg in an amount of from 0.5 to 5.0% by weight, Ni in an amount of from 2.0 to 10% by weight, Zr in an amount of from 0.5 to 2.0% by weight and Si in an amount of from 3.0 to 20% by weight.

34. The aluminum alloy according to claim 33, wherein said matrix includes said Mg in an amount of from 0.5 to 3.0% by weight.

35. The aluminum alloy according to claim 33, wherein said matrix includes said Ni in an amount of from 2.0 to 7.0% by weight.

36. The aluminum alloy according to claim 35, wherein said matrix includes said Ni in an amount of from 2.0 to 5.7% by weight.

37. The aluminum alloy according to claim 33, wherein said matrix includes said Si in sn amount of from 3.0 to 15% by weight.

38. The aluminum alloy according to claim 26, wherein said boride particles have an average particle diameter of from 2.0 to 10 micrometers.

39. The aluminum alloy according to claim 26, wherein said boride is at least one member selected from the group consisting of nickel boride, titanium boride, magnesium boride and iron boride.

40. The aluminum alloy according to claim 26, wherein said iron compound particles have an average particle diameter of from 2.0 to 10 micrometers.

41. The aluminum alloy according to claim 26, wherein said iron compound is at least one member selected from the group consisting of iron boride, iron nitride and iron phosphide.

* * * * *

UNITED STATES PATENT AND TRADEMARK OFFICE

CERTIFICATE OF CORRECTION

PATENT NO. : 5,478,418

DATED : December 26, 1995

INVENTOR(S) : Hirohisa MIURA et al.

It is certified that error appears in the above-indentified patent and that said Letters Patent is hereby corrected as shown below:

CLAIM 3, Col. 16, Line 40 before "weight" insert --by--.

CLAIM 4, Col. 16, Line 42 change "form" to --from--;
Col. 16, Line 43 before "weight" insert --by--.

CLAIM 22, Col. 17, Line 47 change "particles (second occurrence)" to --particle--.

CLAIM 28, Col. 18, Line 18 before "weight" insert --by--.

CLAIM 29, Col. 18, Line 21 before "weight" insert --by--.

CLAIM 30, Col. 18, Line 25 before "weight" insert --by--.

CLAIM 37, Col. 18, Line 46 change "sn" to --an--.

Signed and Sealed this

Twenty-first Day of May, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,478,418

DATED : December 26, 1995

INVENTOR(S) : Hirohisa Miura et al.

It is certified that error appears in the above-indentified patent and that said Letters Patent is hereby corrected as shown below:

Title page, item [75] third inventor should be inserted "Kunihiko Imahashi, Togo-cho".

Signed and Sealed this

Tenth Day of September, 1996

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,478,418

DATED : December 26, 1995

INVENTOR(S) : Hirohisa Miura et al.

It is certified that error appears in the above-indentified patent and that said Letters Patent is hereby corrected as shown below:

Title page, third inventor should be inserted "Kunihiko Imahashi, Togo-cho"; and second Assignee, should be changed from "Toyo Aluminum Kabushiki Kaisha" to --Toyo Aluminium Kabushiki Kaisha--.

Signed and Sealed this

Fifth Day of November, 1996

Bruce Lehman

*Attest:*

BRUCE LEHMAN

*Attesting Officer*

*Commissioner of Patents and Trademarks*